US007740333B2

(12) United States Patent
Takei et al.

(10) Patent No.: US 7,740,333 B2
(45) Date of Patent: Jun. 22, 2010

(54) PRINTHEAD, HEAD CARTRIDGE, AND PRINTING APPARATUS USING RESTRICTION CIRCUIT FOR RESTRICTING INPUT OF SIGNALS

(75) Inventors: Yasunori Takei, Tokyo (JP); Kimiyuki Hayasaki, Yokohama (JP); Masahiko Ogawa, Hino (JP); Yuichiro Akama, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 302 days.

(21) Appl. No.: 11/953,990

(22) Filed: Dec. 11, 2007

(65) Prior Publication Data

US 2009/0009545 A1 Jan. 8, 2009

(30) Foreign Application Priority Data

Dec. 13, 2006 (JP) ..... 2006-336387

(51) Int. Cl.
*B41J 29/38* (2006.01)
*B41J 2/05* (2006.01)

(52) U.S. Cl. ..... 347/9; 347/57

(58) Field of Classification Search ..... 347/9
See application file for complete search history.

(56) References Cited

U.S. PATENT DOCUMENTS 5,281,980 A 1/1994 Kishida et al. ..... 346/140 R
6,116,714 A 9/2000 Imanaka et al. ..... 347/19
6,243,111 B1 * 6/2001 Imanaka et al. ..... 347/13
6,359,639 B1 * 3/2002 Kitta et al. ..... 347/211
6,366,123 B1 4/2002 Liu et al.
6,409,300 B2 6/2002 Imanaka et al. ..... 347/19
6,616,257 B2 9/2003 Imanaka et al. ..... 347/10

FOREIGN PATENT DOCUMENTS

JP 10166583 A * 6/1998
JP 2005199665 A * 7/2005

* cited by examiner

*Primary Examiner*—Matthew Luu
*Assistant Examiner*—Shelby Fidler
(74) *Attorney, Agent, or Firm*—Fitzpatrick, Cella, Harper & Scinto

(57) ABSTRACT

A printhead tolerant of switching noise that occurs when concurrently driving plural printing elements, a head cartridge using the printhead, and a printing apparatus can be provided. The printhead includes plural printing elements and plural driving elements for driving the plural printing elements, and prints using these printing elements. The printhead also includes a shift register which receives print data in synchronism with a clock signal, and a latch circuit which latches the print data input to the shift register in synchronism with a latch signal. The printhead further includes a restriction circuit which restricts input of the print data and clock signal to the shift register and input of the latch signal to the latch circuit in synchronism with input of an enable signal for driving the plural driving elements.

1 Claim, 7 Drawing Sheets

PRIOR ART

PRINTHEAD, HEAD CARTRIDGE, AND PRINTING APPARATUS USING RESTRICTION CIRCUIT FOR RESTRICTING INPUT OF SIGNALS

BACKGROUND OF THE INVENTION

1. Field of the Invention

The present invention relates to a printhead, head cartridge, and printing apparatus. Particularly, the present invention relates to an inkjet printhead having many printing elements, a head cartridge, and a printing apparatus using any of them.

2. Description of the Related Art

A printhead with an array or arrays of printing elements has conventionally been known. On a printhead of this type, several or several tens of driving integrated circuits capable of concurrently driving N printing elements as one block are formed on the same substrate. Print data are aligned and input in correspondence with the respective printing elements, and can be printed on a print medium such as print paper. Printing apparatuses with printheads of this type can print at high densities and high speeds, and thus are widely used as printers in today's business offices, for other paperwork tasks, and for personal use. Even now, printing apparatuses are developed and improved for further cost reduction, higher resolution, and the like.

A printhead mounted in the inkjet printing apparatus (to be referred to as a printing apparatus hereinafter) is configured by arraying, as printing elements, electrothermal transducers (to be also called heaters hereinafter) for generating discharge energy necessary to discharge ink from nozzles. As a known method for this printhead, printing elements are divided into a plurality of blocks, and the blocks are temporarily driven sequentially or distributedly because large power is necessary to drive printing elements.

Especially for a printing element which prints by discharging ink using heat, if one printing element is continuously driven, heat is accumulated, and the print density may change. The printing element is also influenced by heat of an adjacent printing element. If the printing apparatus concurrently drives adjacent printing elements, nozzles are interfered with mutual pressures generated in ink discharge. The pressure interference (crosstalk) may change the print density. Hence, an idle time for dissipating heat or avoiding crosstalk is desirably set after driving the printing element.

To solve this problem, there is known distributed driving of distributedly driving printing elements to be concurrently driven in the array direction of the printing elements. According to this driving method, adjacent printing elements are not concurrently driven. By setting an idle time, the influence of an adjacent printing element can be eliminated.

FIG. 7 is a diagram showing the arrangement of a printhead which performs time-divisional driving.

In a specific example shown in FIG. 7, an enable signal which is input from a terminal 5*a* to enable driving a printing element is commonly supplied to all printing elements 1. In FIG. 7, reference numeral 3*a* denotes a terminal to apply a power supply voltage VH to the printing element as a voltage for driving a heater; and 4*a*, a ground (GND) terminal.

In a conventional printhead shown in FIG. 7, print data and a clock signal are respectively input from terminals 8*a* and 8*b*, and the print data is stored in a shift register 8. A latch signal is input from a terminal 7*a*, and the print data is latched by a latch circuit 7. By aligning print data in correspondence with printing elements, the printing elements of each block can be energized in accordance with the print data for the period of the latch signal.

Further in this arrangement, a block control signal is input from a terminal 6*a* and supplied to a decoder circuit 6. The decoder circuit 6 generates a block selection signal for selecting a block of four printing elements on the basis of the input block control signal. An AND circuit 5 receives the print signal from the latch circuit 7, the block selection signal from the decoder circuit 6, and the enable signal. When the logical value of these signals is "1", the AND circuit 5 outputs a driving signal to a driver (transistor) 2, driving a corresponding printing element.

Time-divisional driving can be achieved by sequentially activating a block selection signal and supplying an enable signal from the terminal 5*a* in correspondence with each block within the period of each latch signal.

The printhead is configured to deal with various kinds of driving control by shortening the rise/fall time of a driving signal pulse so as to realize high-resolution control within the period of a latch signal.

This technique is disclosed in, e.g., the U.S. Pat. No. 6,116,714.

However, when the conventional printhead is to achieve high print speed, high-resolution color printing, and downsizing, the arrangeable wiring width on the printhead substrate becomes narrow, and the number of concurrently driven printing elements increases. Due to these factors, the print current flowing into the wiring causes the following problem.

This problem is a malfunction of a driving control circuit by switching noise occurred due to a great change of an electric current flowing into a wiring when a pulse-like driving signal rises and falls in concurrent driving. Since the driving signal is controlled temporarily at high resolution, as described above, a driver incorporated in the printhead must be turned on/off quickly. Assuming that the rise/fall time t of the driver is 100 nsec, the self-inductance L of the wiring is 100 nH, and the current I flowing at this time is 1 A, an induced voltage V generated at this time is given by $$V=L\cdot dI/dt=100\times10^{-9}\times1/100\times10^{-9}=1\text{ V}$$

From this, the induced voltage as high as 1 V is generated as noise.

This noise level greatly affects a logic gate circuit formed from a CMOS, TTL, or the like. Especially for a CMOS circuit whose logic voltage is 3.3 V or less, this induced voltage value almost reaches the threshold level. The switching noise may cause a fatal influence on the printhead operation on a head substrate prepared by integrating, on the same substrate, a printing element driver for switching a large current, and a logic gate circuit formed from a CMOS, TTL, or the like.

The print speed and print resolution are increased by increasing the number of printing elements of the printhead. As the number of printing elements increases, the number of time-divisionally driven blocks and the number of concurrently drivable printing elements may also increase. However, in view of increasing the print speed, the increase of the number of blocks is restricted. This naturally leads to increasing the number of concurrently drivable printing elements. This means that the instantaneous change of the current value becomes large and the noise level becomes high.

The problem of switching noise has conventionally been known, and several countermeasures against this problem have been proposed.

For example, input of a driving signal pulse to printing elements to be concurrently driven is delayed stepwise. According to this method, considering the level and occurrence time of switching noise, delay elements are properly inserted into driving signal lines to delay stepwise, by more than the occurrence time, a timing when the driving signal pulse is applied. This method can suppress occurrence of switching noise. However, according to this method, if the number of concurrently driven printing elements increases, the total delay time becomes long. This results in causing restriction on assigning the driving signal pulse width permissible time during which all printing elements are driven within the printhead printing period (i.e., time for giving a chance to drive all printing elements).

As another method, the rise time of the driving signal pulse and the instantaneous current value are specified, and wiring lines and terminals are dielectrically isolated to adjust the print current to the specified value or less. Even according to this method, the increase in print current by the increase in the number of concurrently driven printing elements cannot be satisfactorily coped with by the dielectric isolation of wiring lines and terminals.

SUMMARY OF THE INVENTION

Accordingly, the present invention is conceived as a response to the above-described disadvantages of the conventional art.

For example, a printhead according to this invention is tolerant of switching noise occurred when concurrently driving a plurality of printing elements.

According to one aspect of the present invention, preferably, there is provided a printhead including a plurality of printing elements and a plurality of driving elements for driving the plurality of printing elements, and which prints by the plurality of printing elements, the printhead comprising: a shift register which receives print data in synchronism with a clock signal; a latch circuit which latches the print data input to the shift register in synchronism with a latch signal; and a restriction circuit which restricts input of the print data and the clock signal to the shift register and input of the latch signal to the latch circuit in accordance with input of an enable signal for driving the plurality of driving elements.

In accordance with the configuration as above, even if the number of printing elements inevitably increases for high-speed printing and the number of concurrently driven printing elements increases for high-density implementation, occurred switching noise does not influence input of print data, and stable printing can be achieved.

According to another aspect of the present invention, preferably, there is provided a head cartridge integrating the above printhead and an ink tank containing ink to be supplied to the printhead.

According to still another aspect of the present invention, preferably, there is provided a printing apparatus using the above printhead.

The invention is particularly advantageous since switching noise of an element occurred upon concurrently driving a plurality of printing elements at high speed does not influence input of print data, and a more stable printing operation can be achieved.

Further features of the present invention will become apparent from the following description of exemplary embodiments (with reference to the attached drawings).

DESCRIPTION OF THE EMBODIMENTS

Figure 1:
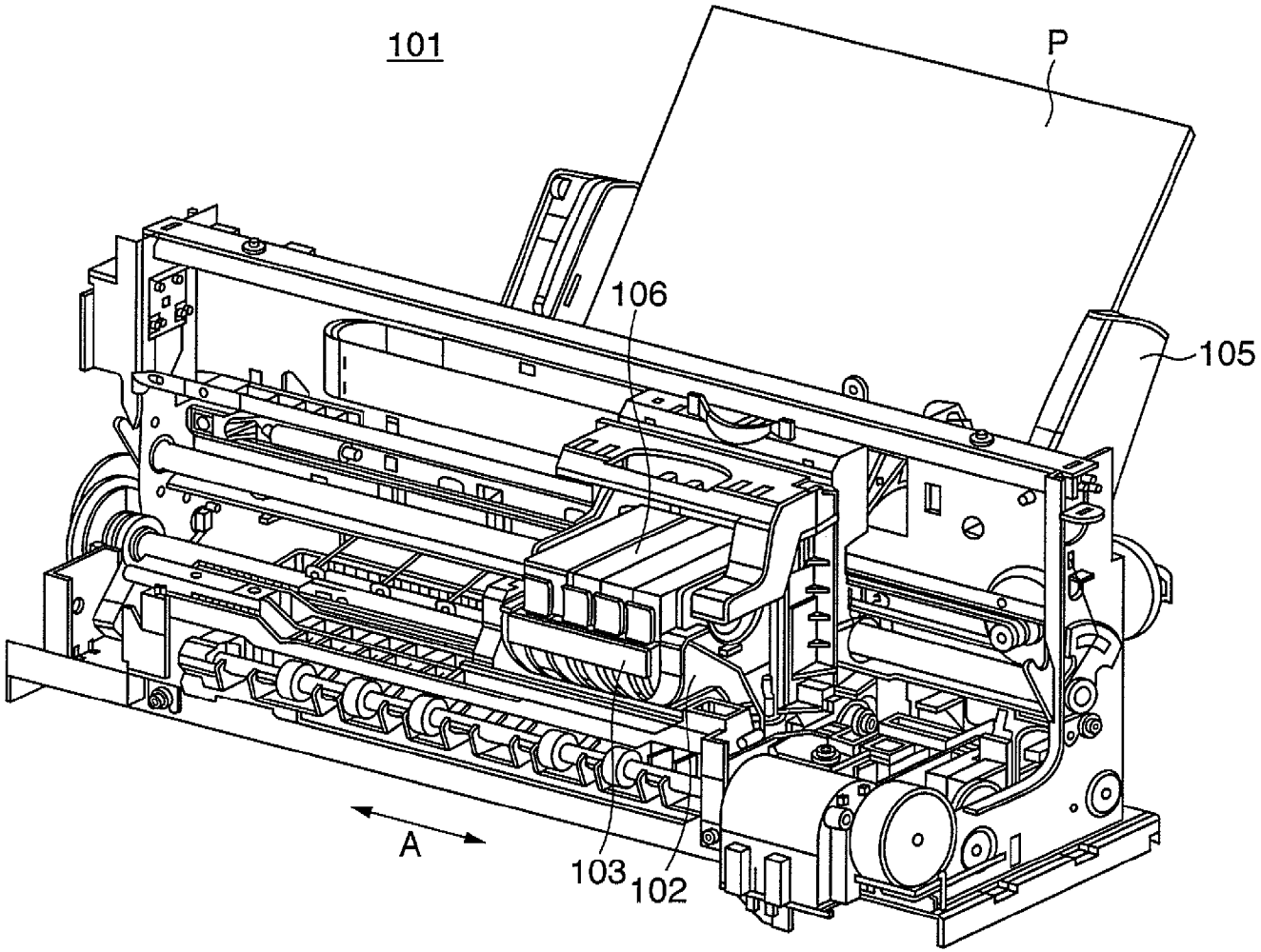
FIG. 1 is a schematic perspective view showing the outer appearance of the structure of an inkjet printing apparatus as a typical embodiment of the present invention.

Preferred embodiments of the present invention will now be described in detail in accordance with the accompanying drawings. The same reference numerals denote the same parts, and a description thereof will not be repeated.

In this specification, the terms "print" and "printing" not only include the formation of significant information such as characters and graphics, but also broadly include the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

The term "printing element" broadly includes an orifice, a liquid channel communicating with the orifice, and an element for generating energy used to discharge ink, unless otherwise specified.

The term "printhead substrate (head substrate)" in the description not only includes a simple substrate made of a silicon semiconductor, but also broadly includes a substrate with elements, wiring lines, and the like.

The expression "on a substrate" not only includes "on an element substrate", but also broadly includes "on the surface of an element substrate" and "inside of an element substrate near its surface". The term "built-in" in the present invention not only includes "simply arrange separate elements on a substrate surface", but also broadly includes "integrally form and manufacture elements on an element substrate by a semiconductor circuit manufacturing process or the like".

A typical overall arrangement and control arrangement of a printing apparatus using a printhead according to the present invention will be described.

<Description of Inkjet Printing Apparatus (FIG. 1)>

FIG. 1 is a schematic perspective view showing the outer appearance of the structure of an inkjet printing apparatus 101 as a typical embodiment of the present invention.

In the inkjet printing apparatus (to be referred to as a printing apparatus hereinafter), as shown in FIG. 1, a carriage 102 supports an inkjet printhead 103, and the printhead prints by discharging ink. A print medium P such as print paper is fed via a paper feed mechanism 105 and conveyed to a print position. At the print position, the printhead 103 prints by discharging ink to the print medium P.

The carriage 102 of the printing apparatus 101 supports not only the printhead 103, but also an ink cartridge 106 which contains ink to be supplied to the printhead 103. The ink cartridge 106 is detachable from the carriage 102.

The printing apparatus 101 shown in FIG. 1 can print in color. For this purpose, the carriage 102 supports four ink cartridges which respectively contain magenta (M), cyan (C), yellow (Y), and black (K) inks. The four ink cartridges are independently detachable.

The printhead 103 according to the embodiment employs an inkjet method of discharging ink by using heat energy. For this purpose, the printhead 103 comprises, as a printing element, an electrothermal transducer for generating heat energy. The electrothermal transducer is arranged in correspondence with each orifice. By applying a pulse voltage to an electrothermal transducer corresponding to a print signal, ink is discharged from a corresponding orifice.

<Control Arrangement of Inkjet Printing Apparatus (FIG. 2)>

Figure 2:
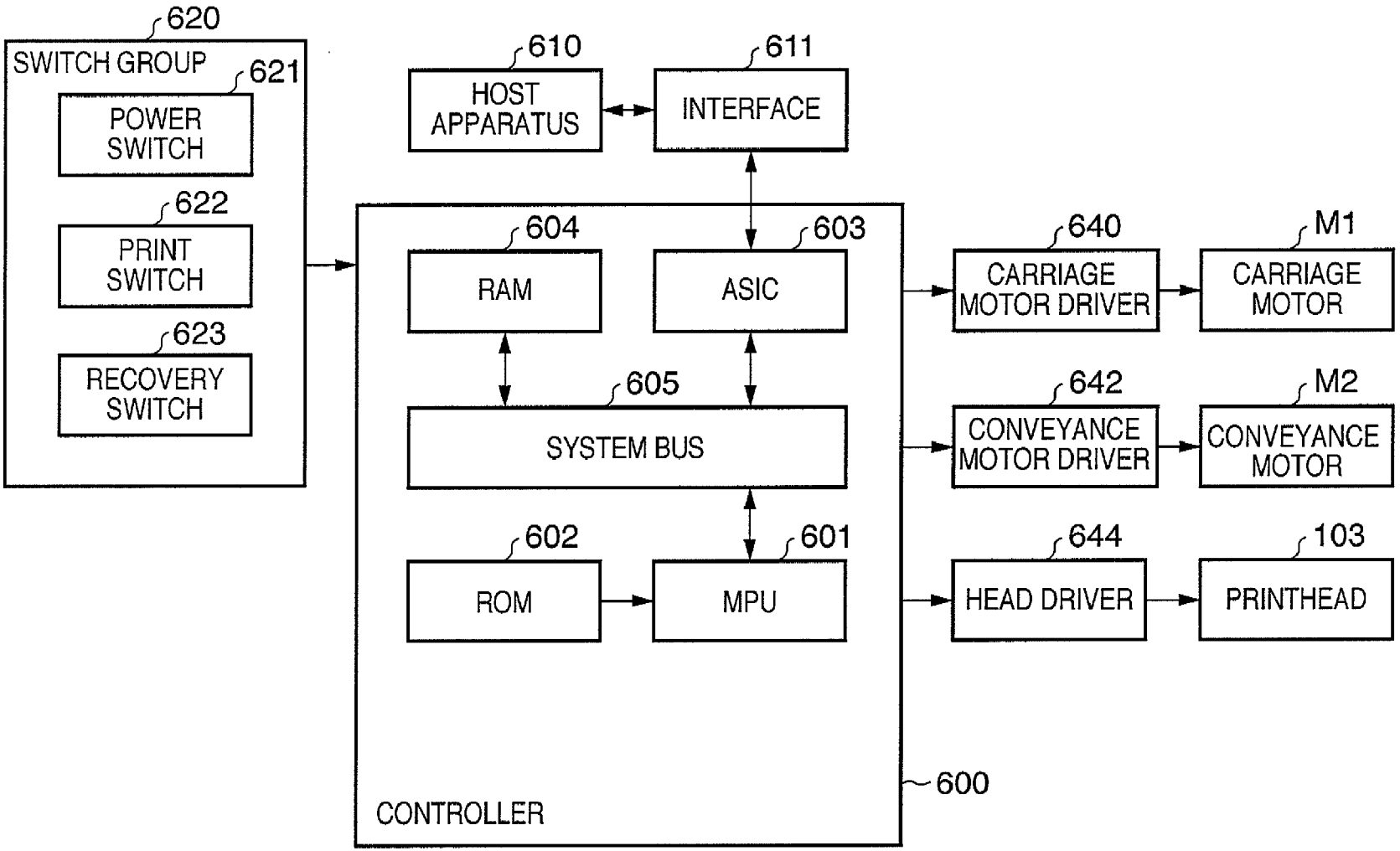
FIG. 2 is a block diagram showing the arrangement of the control circuit of the printing apparatus.

FIG. 2 is a block diagram showing the control arrangement of the printing apparatus shown in FIG. 1.

As shown in FIG. 2, a controller 600 comprises a MPU 601, ROM 602, ASIC (Application Specific Integrated Circuit) 603, RAM 604, system bus 605, and A/D converter 606. The ROM 602 stores a program corresponding to a control sequence (to be described later), a predetermined table, and other permanent data. The ASIC 603 generates control signals for controlling a carriage motor M1, a conveyance motor M2, and the printhead 103. The RAM 604 is used as an image data expansion area, a work area for executing a program, and the like. The system bus 605 connects the MPU 601, ASIC 603, and RAM 604 to each other, and allows exchanging data.

In FIG. 2, a computer (or an image reader, digital camera, or the like) 610 serves as a print data source and is generally called a host apparatus. The host apparatus 610 and printing apparatus 101 transmit/receive image data, commands, status signals, and the like via an interface (I/F) 611. Image data is input as, e.g., raster data.

A switch group 620 includes a power switch 621, print switch 622, and recovery switch 623.

A carriage motor driver 640 can drive the carriage motor M1 for reciprocating the carriage 102 in the directions indicated by the arrow A as shown in FIG. 1. A conveyance motor driver 642 drives the conveyance motor M2 for conveying the print medium P. A head driver 644 drives the printhead 103.

The ASIC 603 transfers print data DATA of a printing element (heater) to the printhead while directly accessing the memory area of the RAM 604 in printing and scanning by the printhead 103. In addition, the printhead 103 receives control signals from the MPU 601 and ASIC 603 via the head driver 644. The printhead 103 also receives power from a power supply (not shown).

Figure 3:
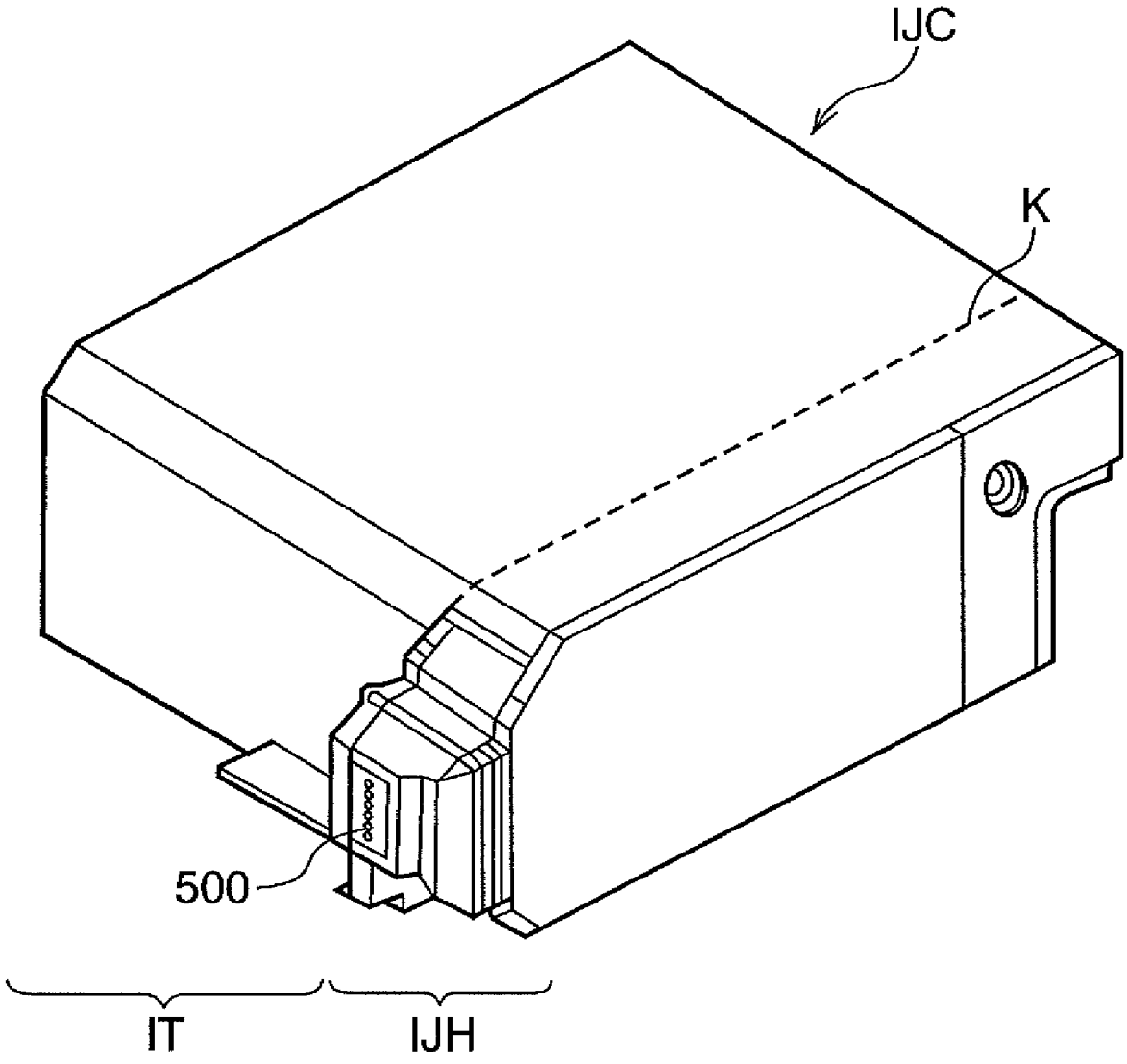
FIG. 3 is a perspective view showing the outer appearance of the structure of a head cartridge IJC which integrates an ink tank and printhead.

FIG. 3 is a perspective view showing the outer appearance of the structure of a head cartridge IJC which integrates the ink tank and printhead. In FIG. 3, a dotted line K indicates the boundary between an ink tank IT and a printhead IJH. The head cartridge IJC has an electrode (not shown) to receive an electrical signal supplied from the carriage 102 when the head cartridge IJC is mounted on the carriage 102. The electrical signal drives the printhead IJH to discharge ink, as described above.

In FIG. 3, reference numeral 500 denotes an ink orifice array.

An embodiment of the printhead mounted in the printing apparatus having the above-described arrangement will be described.

Figure 4:
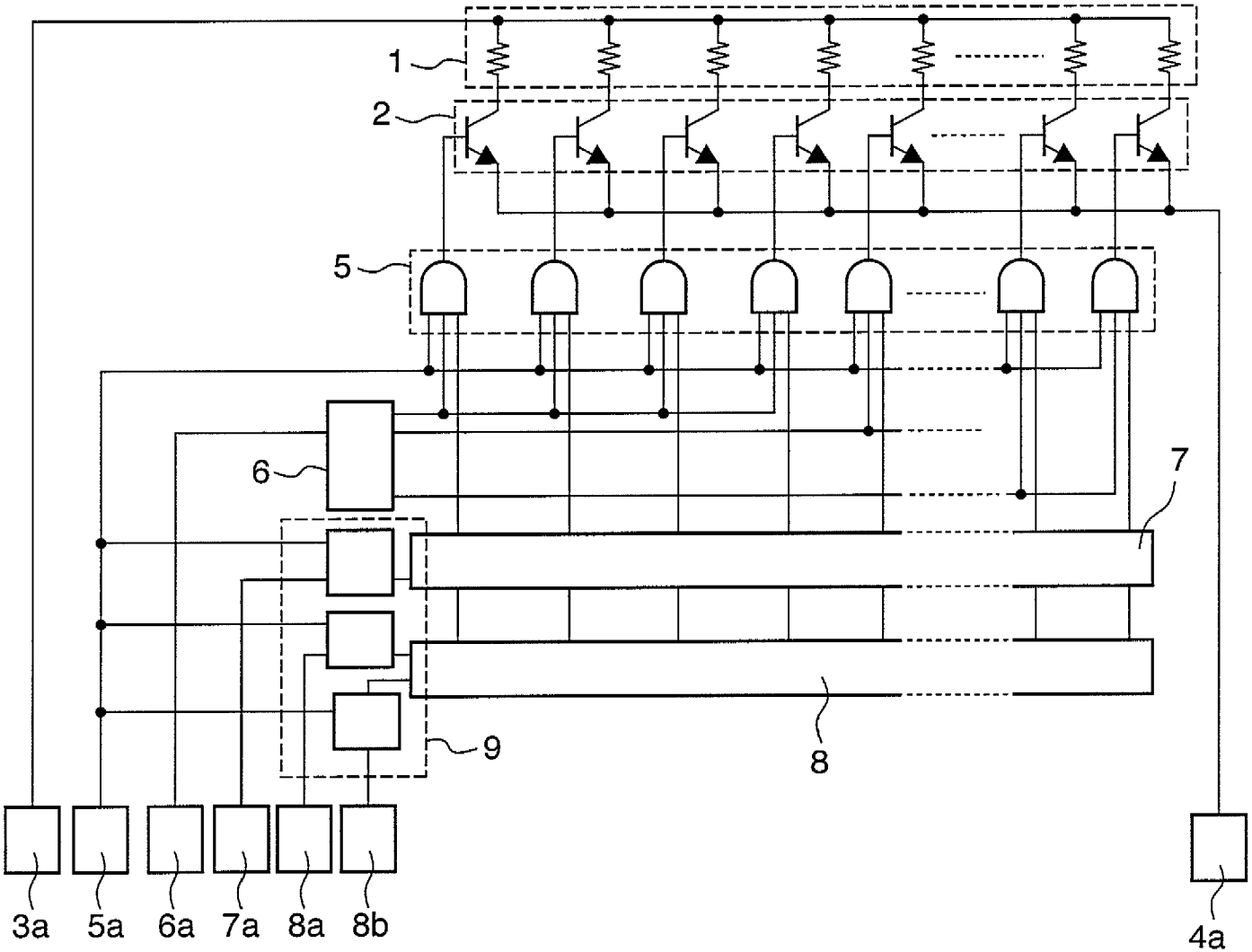
FIG. 4 is a circuit diagram showing the circuit arrangement of the printhead.

FIG. 4 is a circuit diagram showing a circuit arrangement on the head substrate of the printhead.

Figure 7:
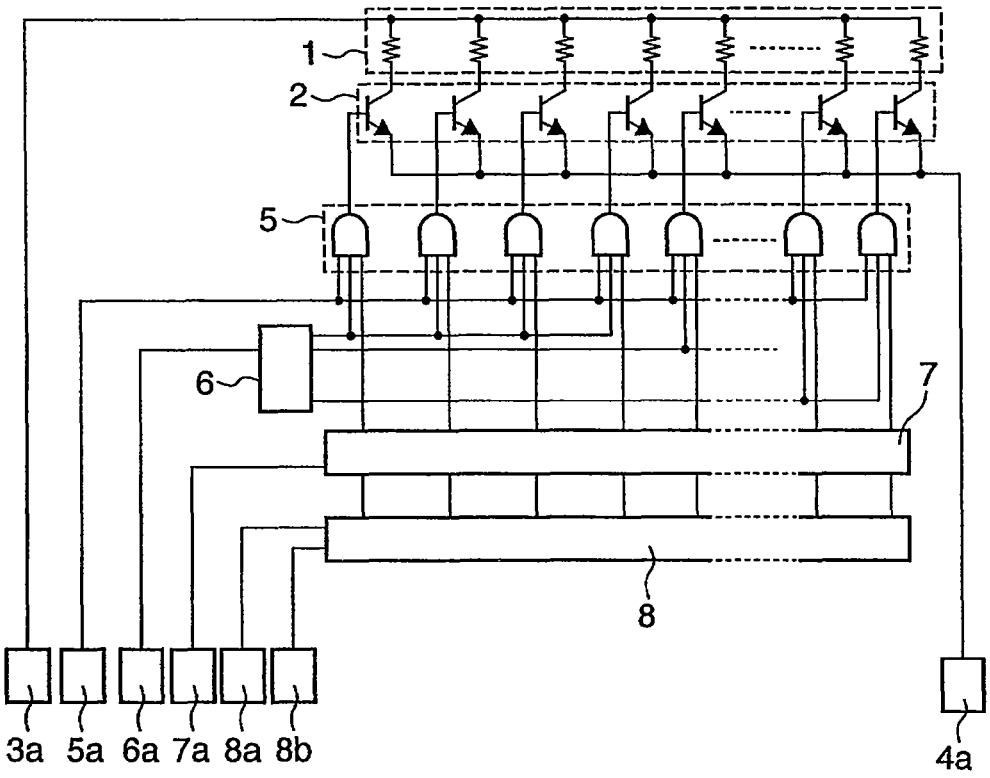
FIG. 7 is a diagram showing the circuit arrangement of a conventional printhead.

In FIG. 4, the same reference numerals as those in FIG. 7 showing the conventional art denote the same parts, and a description thereof will not be repeated. Basically, a plurality of printing elements in the printhead are one-dimensionally arrayed in a predetermined direction, forming a printing element array. The length of the printing element array corresponds to the print width.

In FIG. 4, when a pulse-like enable signal is input to an AND circuit 5, a restriction circuit 9 inactivates print data control lines which connect terminals 7*a*, 8*a*, and 8*b* to a latch circuit 7 and shift register 8. The restriction circuit restricts the operations of the shift register and the like when inputting an enable signal.

Figure 5:
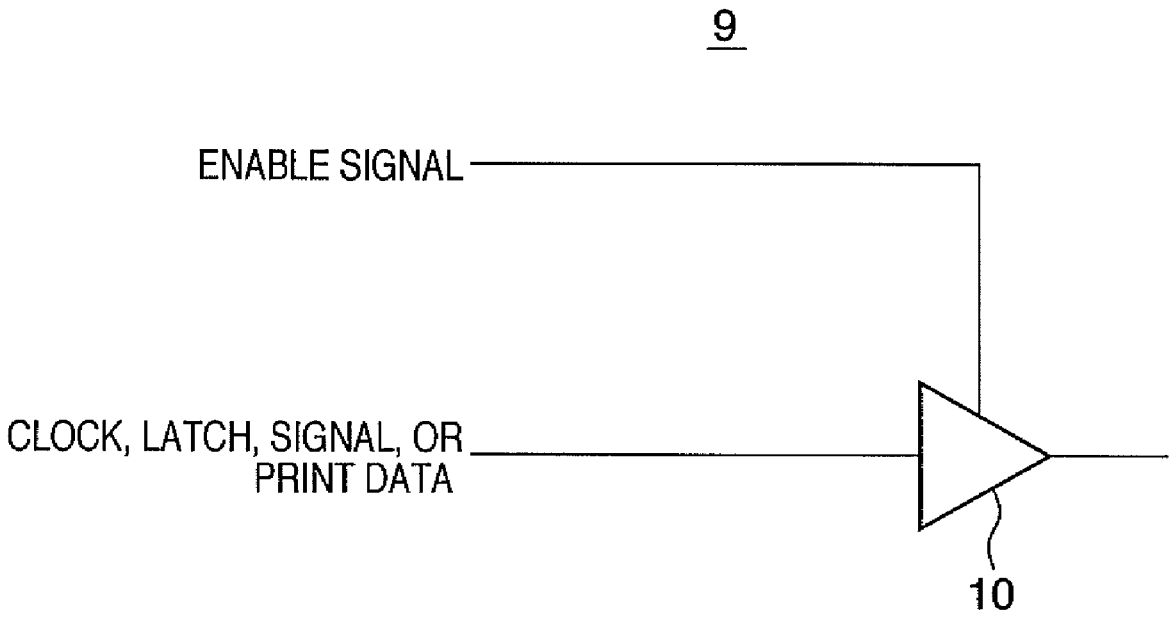
FIG. 5 is a block diagram showing the arrangement of a restriction circuit.

FIG. 5 is a block diagram showing the internal arrangement of the restriction circuit 9.

As shown in FIG. 5, the restriction circuit 9 is formed from a tristate buffer 10 (FIG. 5 typically illustrates one tristate buffer 10). The tristate buffer 10 enables/disables a clock signal, print data, and a latch signal in synchronism with an enable signal. The tristate buffer 10 has a rise/fall (quick response) characteristic fast enough to turn on/off the tristate buffer 10 in correspondence with the ON/OFF operation of the enable signal.

The restriction circuit 9 is interposed between the terminals 7*a*, 8*a* and 8*b*, and the latch circuit 7 and shift register 8. During a period of the enable signal being ON, the shift register 8 should not receive print data and a clock signal and the latch circuit 7 should not receive a latch signal in the first place. With the restriction circuit 9, signal input lines corresponding to the print data, clock signal and latch signal are disabled. As a result, the influence of switching noise occurred at the rise of an enable signal can be avoided because the signal input lines connected to the shift register and latch circuit are disabled.

Figure 6:
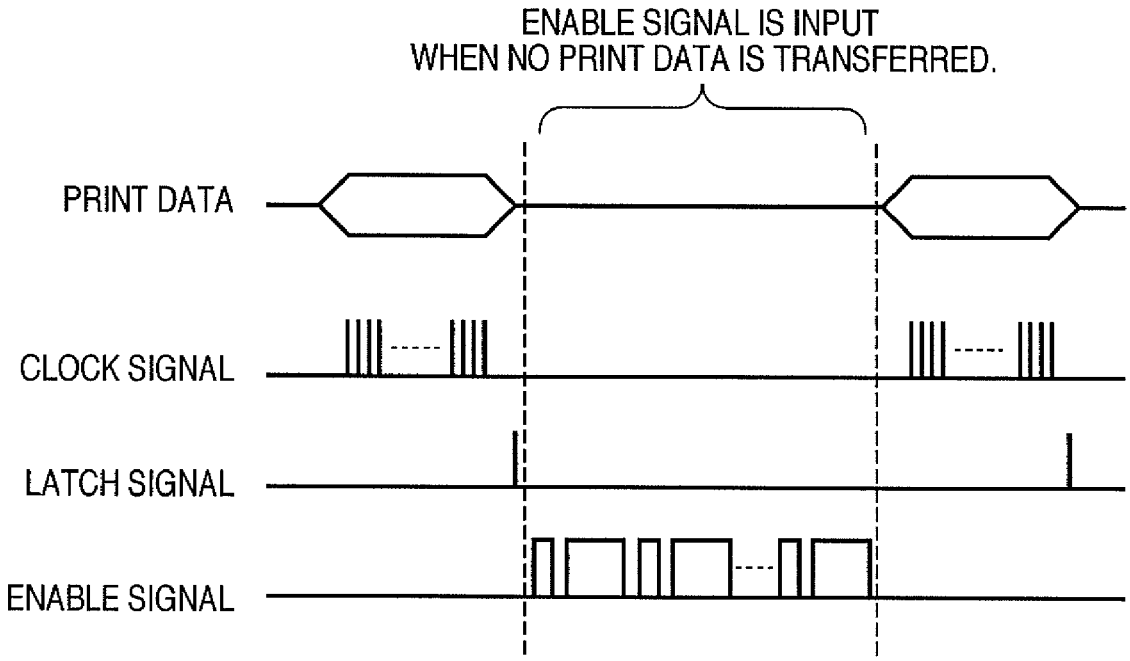
FIG. 6 is a timing chart showing the timings of print data, a clock signal, latch signal, and enable signal in the printhead.

FIG. 6 is a timing chart showing the relationship between the timings of print data, a clock signal, latch signal, and enable signal.

As is apparent from FIG. 6, according to the embodiment, an enable signal is input when no print data is transferred. This control can be realized by disabling the signal input line by the restriction circuit when inputting an enable signal pulse.

According to the above-described embodiment, signal lines for inputting print data, a clock signal, and latch signal are disabled when inputting an enable signal pulse. The influence of switching noise on input of signals to the shift register and latch circuit can be avoided.

Even if switching noise occurs, a malfunction by input of signals to the shift register and latch circuit can be prevented.

In the above-described embodiments, droplets discharged from the printhead are ink, and the liquid contained in the ink tank is ink. However, the content is not limited to ink. For example, the ink tank may also contain a process liquid which is discharged to a print medium in order to improve the fixing characteristic and water repellency of a printed image and improve the print quality.

In the above-described embodiments, high print density and high resolution can be achieved by, of inkjet printing methods, a method of changing the ink state by heat energy generated by a means (e.g., electrothermal transducer) for generating heat energy to discharge ink.

In addition, the inkjet printing apparatus according to the present invention may also take the form of an image output apparatus for an information processing apparatus such as a computer, the form of a copying apparatus combined with a reader or the like, and the form of a facsimile apparatus having transmission and reception functions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-336387, filed Dec. 13, 2006, which is hereby incorporated by reference herein in its entirety.

What is claimed is:

1. A printhead including a plurality of printing elements and a plurality of driving elements for driving the plurality of printing elements, wherein the printhead prints by using the plurality of printing elements, the printhead comprising:

a shift register which receives print data in synchronism with a clock signal;

a latch circuit which latches the print data input to said shift register in synchronism with a latch signal; and a restriction circuit which restricts input of the print data and the clock signal to said shift register and input of the latch signal to said latch circuit in accordance with input of an enable signal for driving the plurality of driving elements, wherein said restriction circuit includes a tristate buffer, wherein a characteristic of said tristate buffer includes a rise response fast enough to turn on/off said tristate buffer in synchronism with an ON/OFF operation of the enable signal, and wherein when the enable signal is ON, said tristate buffer disables signal lines for supplying the print data, the clock signal, and the latch signal.

* * * * *